United States Patent [19]

Siber

[11] 4,007,935

[45] Feb. 15, 1977

[54] SPINNING TOP BOWLING GAME

[76] Inventor: Erwin-Walter C. Siber, 175 Stonehenge Drive, Beaconsfield, Quebec, Canada

[22] Filed: Apr. 30, 1975

[21] Appl. No.: 573,314

[52] U.S. Cl. ..... 273/108; 46/65; 46/73

[51] Int. Cl.[2] ..... A63B 67/16

[58] Field of Search ..... 273/108, 37, 38, 39, 273/118 R, 118 A, 119 R, 119 A; 46/64, 65, 73

[56] References Cited

UNITED STATES PATENTS

| | | | |
|---|---|---|---|
| 197,091 | 11/1877 | Brown | 273/118 R |
| 202,318 | 4/1878 | Witsil | 273/37 UX |
| 2,035,975 | 3/1936 | Meyer | 273/37 X |
| 3,178,184 | 4/1965 | Glassman | 273/108 |
| 3,429,573 | 2/1969 | Cederberg | 46/64 X |

FOREIGN PATENTS OR APPLICATIONS

| | | | |
|---|---|---|---|
| 764,475 | 3/1934 | France | 273/108 |
| 349,897 | 3/1922 | Germany | 273/108 |
| 359,763 | 9/1922 | Germany | 273/108 |
| 263,306 | 11/1949 | Switzerland | 273/37 |

*Primary Examiner*—Anton O. Oechsle
*Attorney, Agent, or Firm*—Wolf, Greenfield & Sacks

[57] ABSTRACT

A bowling-like game played with pins and a spinning top on an inclined board surface. An array of spots is marked adjacent one end of the board and a starting area is marked at the other end of the board. The spots are coded to indicate a variety of different pin arrangement and provide for a variety of different scoring techniques. Thus, the spots as well as the pin fall may contribute to the scoring. The tip of the top is specially shaped to enable a player to direct the top in any one of several courses.

9 Claims, 8 Drawing Figures

FIG. 1
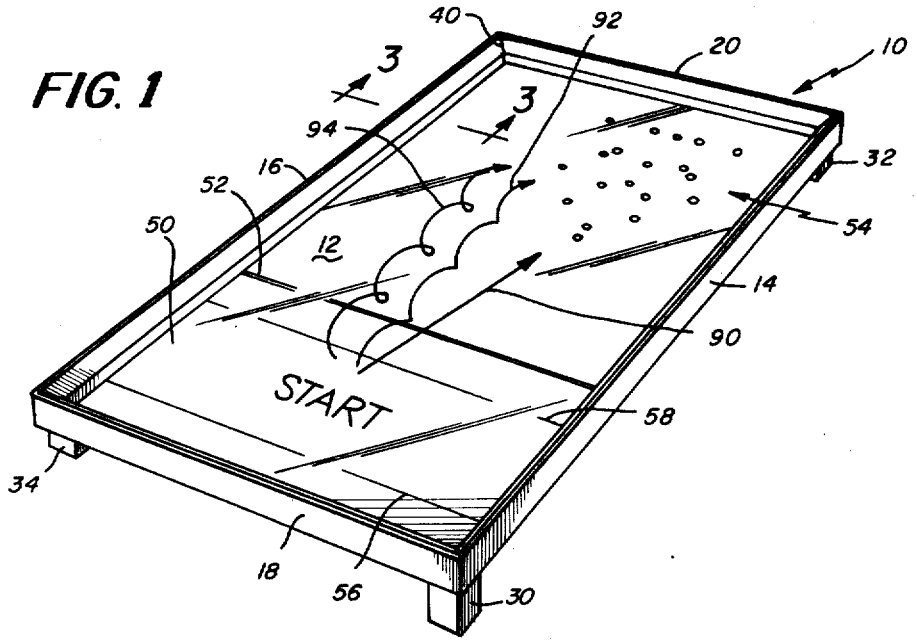
FIG. 2
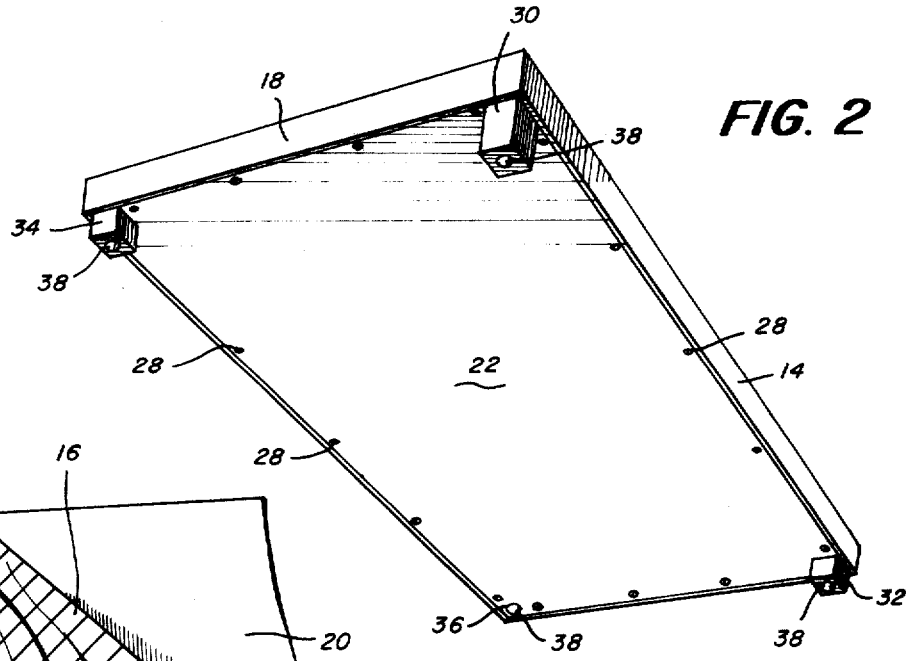
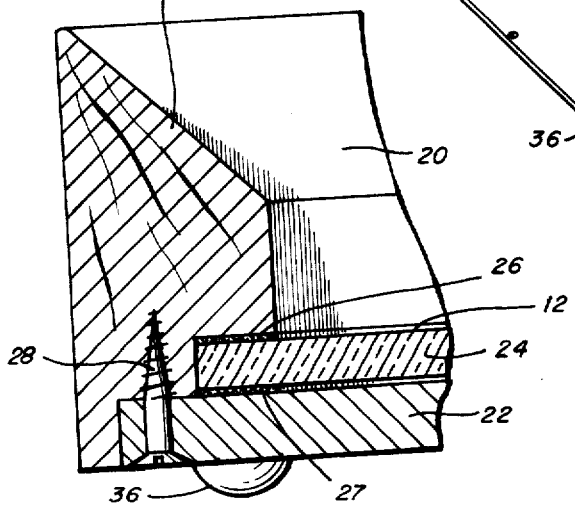
FIG. 3

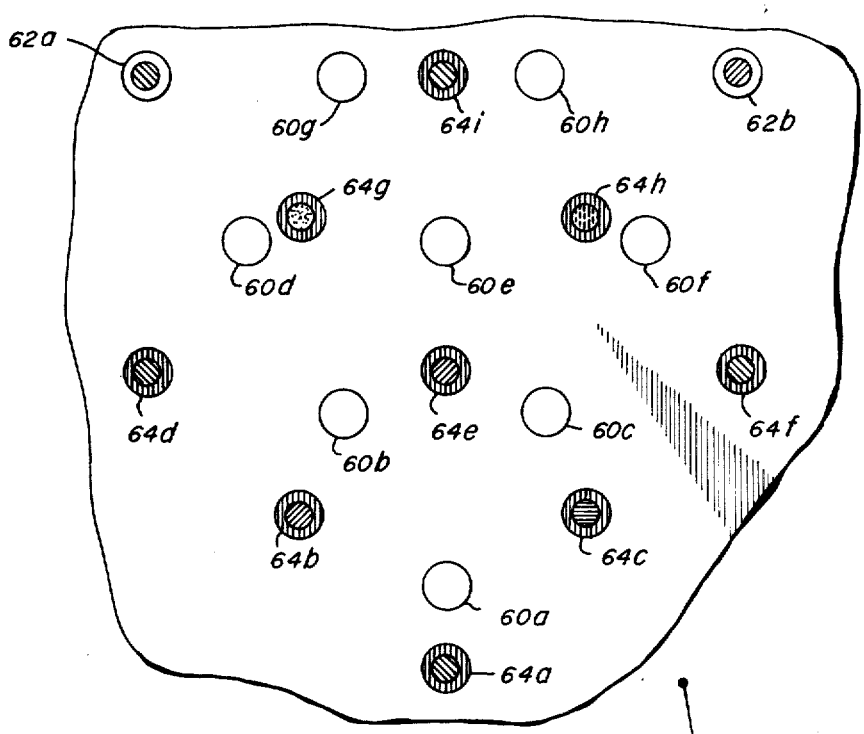
FIG. 4
FIG. 5
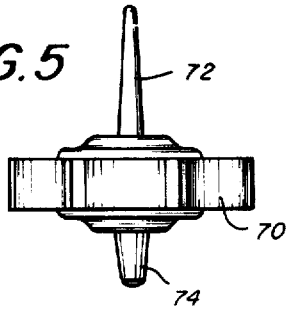
FIG. 6
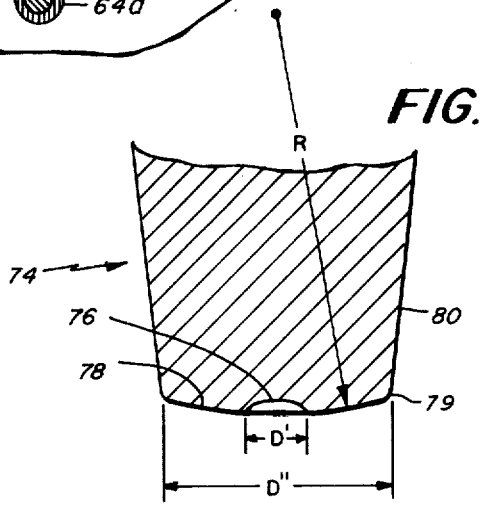
FIG. 7
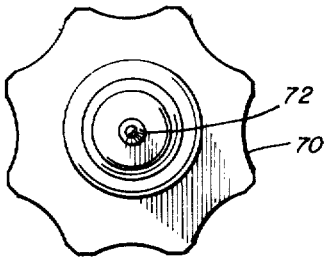
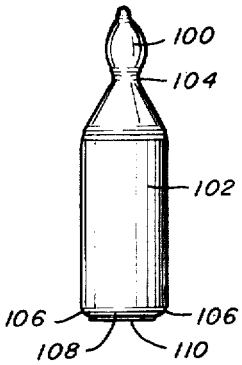
FIG. 8

SPINNING TOP BOWLING GAME

INTRODUCTION

This invention relates to games and more specifically to a bowling-like game played on an inclined board and on which an array of bowling pins is spotted, and a spinning top is used to topple the pins. Games of this type are shown in U.S. Pat. No. 3,178,184 dated Apr. 13, 1965 and German Patents Nos. 335,586 and 349,897 dated Apr. 7, 1921 and Mar. 10, 1922, respectively. In particular, this invention embodies improvements in both the top and the pin arrangement to increase the number of games which may be played and to increase the precision with which the top may be spun.

In the pin and top bowling-like games shown in the prior United States and German patents, supra, a rectangular playing surface is provided with four legs, all of different height so that the board surface is gently inclined toward one corner. An array of pin spots is applied to the surface in the vicinity of the end of the board which includes the lowest corner. In the prior art, the board either bears a nine pin or ten pin array. The top is spun at the far end of the board, and the object of the game is to knock over either all or a selected number of pins with the spinning top as it proceeds lengthwise along the board. In the prior art, the games are scored as in conventional bowling.

In accordance with the present invention, superimposed nine pin and ten pin arrays of spots are provided on the board surface, and the top is made with a special tip configuration. The superimposed arrays of spots suggest a variety of different ways in which the game may be played, and the special top tip configuration enables the player to cause the top to move along the board surface in one of several different configurations so as to increase the skill which may be employed in the play of the game. Thus, in accordance with the present invention a pin and top bowling-like game is provided having greater versatility and affording the exercise of greater skill than the pin and top games of the prior art.

BRIEF FIGURE DESCRIPTION

FIG. 1 is a perspective view of the game board of the present invention, looking down upon the top surface.

FIG. 2 is a perspective view of the game board looking upwardly from below the bottom.

FIG. 3 is a fragmentary cross-sectional view taken along the section line 3—3 of FIG. 1.

FIG. 4 is a plan view of the pin spot arrangement on the playing surface of the board.

FIG. 5 is a side elevation view of the spinning top of the present invention.

FIG. 6 is an enlarged fragmentary view of the tip of the top.

FIG. 7 is a plan view of the top.

And FIG. 8 is a side elevation view of one of the pins of the present invention.

DETAILED DESCRIPTION

The playing board 10 shown in FIG. 1–4 has a playing surface 12 surrounded by side rails 14 and 16 and end rails 18 and 20. In the preferred form of this invention the playing surface is approximately 15 inches wide and 25 inches long. The side and end rails are rabbeted along the bottom inner corner as shown in FIG. 3 to receive bottom panel 22 and glass sheet 24. Cushion-like strips 26 and 27 made of foam, felt, or some similar material are placed above and below the periphery of the glass 24 to protect its edges between the rails and the bottom panel, and the assembly is held together by a number of screws 28, as is evident in FIGS. 2 and 3. The smooth playing surface 12 of the board defined by the upper surface of the glass is an important characteristic of the invention. That smooth surface enables the top to spin smoothly on the surface in one of several paths as is described in greater detail below.

Four legs 30, 32, 34 and 36 are located at the four corners of the board, cemented or otherwise secured to the lower surface of panel 22. As is evident in FIG. 2, leg 20 is the tallest, leg 32 is the next tallest, leg 34 is somewhat smaller than leg 32, and leg 36 is the shortest of all. In the embodiment shown, the shortest of the four legs 36 is made up only of the rubber foot 38 and does not include the blocktype of leg which is part of the leg structure at the other corners. Leg 30 is approximately ½ inch longer than leg 32, leg 32 is approximately 7/16 inch longer than leg 34, and leg 34 is approximately 5/8 inch longer than leg 36. This arrangement causes the surface 12 to slope gently toward the corner 40 as viewed in FIG. 1. In the preferred embodiment, the slope of the playing surface is approximately 3°–5° from the horizontal measured between side rails 14 and 16, and approximately 1°–2° between end rails 18 and 20.

The bottom panel 22 as seen through the surface of glass sheet 24 bears starting area 50, foul line 52 and pin spot region 54 on its upper surface. The starting area which may be defined by a contrasting color or texture in the upper surface of panel 22 and covered by glass 24 has margin 56 spaced approximately 1¾ inches from rail 18, and the area is approximately 4¾ inches wide. The foul line 52 is approximately 2 inches from the edge 58 of the starting area. In playing the game, the spin of the top is initiated in the starting area 50, and the player may recall the top and spin it over again before it crosses the foul line 52 if for any reason the spin is not to his satisfaction.

The pin spot region 54 as shown in FIG. 4 consists of 19 spots closer to side rail 14 and leg 32 than rail 16 and and corner 40. Contrasting colors of these spots identify two distinct geometrical patterns superimposed on each other. One array of spots is a ten spot arrangement in the configuration of an equilateral triangle in which each spot is equidistant from its neighboring spots, thus conforming to the standard ten pin setting pattern and allowing to play in minature a naturalistic bowling game to the exacting scoring rules of the alley games.

Eight spots **60*a* to 60*h* are shown in FIG. 4 as clear single circles and the two spots 62*a* and 62*b*** consist of two concentric circles with clear outer rings to identify their color coding. (Typically clear or unlined areas of the spots may denote a royal blue color.)

The remaining nine pin array of spots, all bearing numeral 64, superimposes a square configuration on the triangular ten spot arrangement in such a manner that corner spot **64*a* of the square configuration in FIG. 4 locates in the center of the side of the triangle which is formed by spots 62*a*, 60*g*, 60*h* and 62*b*. The diagonal lines of the square formed by spots 64*i*, 64*e* and 64*a*, and by spots 64*d*, 64*e* and 64*f*** respectively, are identical in length with the sides of the triangle.

Each of the spots **64*a* through 64*i* consists of two concentric circles, and the cross hatched areas of all nine outer rings indicate their identical color coding. (For example, cross hatched outer ring areas may denote the color red.) The square arrangement of the nine spots 64***a* through 64*i* conforms to the regulation pin setting pattern of nine pin bowling, and the miniaturized game may be played to the exacting rules and score count of the alley game.

Combining the spots 64*a* through 64*i* of the nine spot configuration of the square pattern with spots 62*a* and 62*b* of the triangular pattern, creates an eleven spot pentagonal array of spots, all of which bear inner dots with outer rings of contrasting colors. In this pattern, spots 62*a* and 62*b* form equispaced four spot lines with spots 64*g*, 64*e* and 64*c* and with spots 64*h*, 64*e* and 64*b* respectively.

The eight spots 60*a* through 60*h* which are shown clear in FIG. 4 and may be solid royal blue in this example, show a distinct eight spot pattern for another pin game, and the spots 60*b* through 60*h* form a distinct equispaced hexagonal seven spot pattern for still another pin game.

The top shown in FIGS. 5–7 is composed of a body 70, spinning shaft 72 and tip 74. The periphery of the body 70 as shown in FIG. 7 is generally octagonal-shaped, and the periphery serves as the striking edge of the body intended to knock down the pins standing on the spots. The scalloped configuration of each side of the body increases the agressive character of the top, i.e., upon striking a pin a greater toppling force is applied than would be if the sides were straight.

The configuration of the tip 74 is critical to enable the top to travel the various patterns described below. In the preferred form tip 74 has a flat or even upwardly dished area 76 at its center that extends to about a quarter of the tip diameter. The central area 76 is defined by a marginal edge 76' which engages the surface 12 of the board as the top spins. The central area 76 blends into a lens-shaped area 78 which in turn, via a minimum blend radius 79 merges into the conical part 80 of tip 74. In the preferred form, the flat or dished area has a diameter D' of 0.040 inch, the radius R is 0.280 inch and the tip diameter D'' is 0.160 inch. If radius R and/or diameter D'' are too large, the top will be unstable. This particular configuration enables the player to control the spinning top so that it follows any one of three basic types of projectories across the board surface from the starting area toward the pin region 54. Depending upon the force of the spin and the angle of the top with respect to the board, the top may be made to follow either a straight line course which tends to climb toward the higher side rail 14 of the board as suggested by line 90, a scallopedlike course which tends to remain parallel with the side rails 14 and 16 as suggested by the line 92, or a looped course which tends to fall off toward the lower side rail 16 as the top travels from the starting area 50. The looped path is suggested by line 94.

If the top tip 74 did not have either the flat or upwardly dished center 76 but rather came to a point or otherwise had a surface engaging area of minimum diameter, (substantially point contact with the playing surface) the top would not readily travel along the board, but would tend to stall in one location or drift in the direction of the fall line of the board. It would not be possible accurately to control the travel of the top. The curved region 78 of the tip is essential to enable the top to travel either the scalloped or looped paths suggested by lines 92 and 94. Thus, the special tip configuration and the sloping board surface cooperate to make the game one involving very considerable skill. It is not merely a game of chance.

In FIG. 8, one of the pins is shown. All of the pins may conform in shape to the one illustrated or alternatively some pins may be different than the others in shape and/or color. The pin shown includes a head 100 and a cylindrical barrel 102 connected by a narrow neck 104. The diameter of the barrel 102 is slightly reduced at its bottom by a chamfer 106 to a diameter substantially equal to the diameter of the spots in area 54. To avoid pins sliding off position on minor impact with tumbling pins or the top, the bottom surface 108 is coated with a high friction material 110 such as rubber or plastic. The center of gravity of the pin is such that it is stable in position on a spot unless struck by another pin or by the top with substantial impact.

The several pin patterns coupled with the different color combinations of the spots lend themselves to a variety of different games that can be played on the board. Quite obviously, by using the ten pin array conventional rules of scoring of the American Bowling Congress can be followed. Similarly, by using the nine pin array the game can be played in accordance with the rules of the Federation Internationale Des Quilleurs. And seven and eight pin games may be played by using the clear single circle spots 60*a*–60*h*, with or without spot 60*a*. In addition, the eleven pin array can be utilized for a variety of additional games. For example, different pins may be given different point values and consideration can be given to the particular pins which remain standing and/or the sequence in which they fall as well as to the number which have been toppled. In addition, the colors of the central dots or circles exposed by toppled pins can be taken into consideration in scoring the game. For example, in the spot array shown in FIG. 4, the color of the center dot is the same in the five spots 64*a*, 64*d*, 64*f*, 62*a* and 64*i* (typically yellow). The color of the center dot of spots 64*b*, 64*e* and 62*b* is another color (typically orange). And the remaining three spots 64*c*, 64*g* and 64*h* have three different colored center dots (typically light blue, green and white). Thus, five different colors are available and each can be accorded a different scoring point factor.

From the foregoing description it will be appreciated that the game of this invention has a great deal of versatility in that it allows a variety of games to be played. The pins and spots together may contribute to the scoring. And the particular configuration of the top tip and surface slope enable players to impart different types of motion to the top in travelling from the starting area to the pins.

Because departures from the embodiment shown will occur to those skilled in the art upon reading the foregoing specification, it is not intended that the breadth of this invention be limited to the specific embodiment illustrated and described. Rather, it is intended that the scope of this invention be determined by the appended claims and their equivalents.

What is claimed is:

1. A bowling type of game played with pins and a spinning top comprising a smooth playing board surface for standing the pins and on which the top may be spun, superimposed arrays of nine and ten spots provided on the board surface denoting the nine pin and ten pin bowling arrangement for the pins, a coding marked on certain of the spots in each array for establishing an eleven pin arrangement for pins on the board surface utilizing selected spots of the nine and ten spot arrays, and a starting area marked on the board surface remote from the superimposed arrays denoting the region in which the spin of the top is to be initiated.

2. A bowling game as defined in claim 1 further characterized by means supporting said board surface in an inclined plane sloped generally from the starting area to the array of spots, a spinning top having a shaft, body and tip arranged to be spun on said board surface, and said top having a specially configured tip including a central portion having a marginal edge providing a line for contact between the tip and playing surface as the top spins, a curved portion extending outwardly and upwardly from the edge of the central portion, and a frustroconical side wall extending upwardly from the curved portion.

3. A bowling game as defined in claim 2 further characterized by said central portion of said top tip having a diameter in the order of 0.040 inch and said curved portion having a radius of curvature in the order of 0.280 inch.

4. A bowling game as defined in claim 1 further characterized by said board surface being rectangular in shape with the array of spots lying adjacent one end of the surface and the starting region adjacent the other end of the surface, legs of unequal height supporting the four corners of the surface, the shortest of the four legs lying at one side of the arrays of spots at the one end of the surface and the next to tallest leg lying at the other side of the arrays of spots at said one end of the surface, and said arrays of spots lying closer to the next to the tallest leg than to the shortest leg.

5. A bowling game as defined in claim 1 further characterized by a foul line denoted on the surface between the starting area and the spots defining the limit of recall for the top once spun on the starting area and moving toward the pins on the spots.

6. A bowling game as defined in claim 1 further characterized by said array of nine spots defining an equilateral triangular pattern and said array of ten spots defining a square pattern.

7. A bowling game as defined in claim 6 further characterized by the length of the diagonal of the square pattern being equal to one side of the equilateral triangle and with one diagonal of the square being perpendicular to the rear side of the triangle with the rear spot of said diagonal being aligned with and in the center of the line of spots in the rear side of the triangle.

8. A bowling game as described in claim 7 further characterized by all the spots of the nine pin array being color coded with one another and all of the spots of the ten pin array being separately color coded.

9. A bowling game as described in claim 8 further characterized by certain of the spots being additionally coded for the assignment of different values.

* * * * *